United States Patent [19]

Corley

[11] Patent Number: 4,471,576

[45] Date of Patent: Sep. 18, 1984

[54] ABRASIVE TOOL FOR SMALL DIAMETER HOLE MACHINING

[75] Inventor: William G. Corley, Dearborn Heights, Mich.

[73] Assignee: Ex-Cell-O Corporation, Troy, Mich.

[21] Appl. No.: 441,472

[22] Filed: Nov. 15, 1982

[51] Int. Cl.[3] ..... B24B 7/00

[52] U.S. Cl. ..... 51/2 R; 51/338

[58] Field of Search ..... 51/338, 339, 340, 341, 51/342, 343, 344, 345, 2 R

[56] References Cited

U.S. PATENT DOCUMENTS

| | | | |
|---|---|---|---|
| 2,580,328 | 12/1951 | Sunnen | 51/338 |
| 2,581,601 | 1/1952 | Peden et al. | 51/338 |
| 2,815,615 | 12/1957 | Sunnen | 51/338 |
| 3,016,660 | 1/1962 | Gross | 51/344 |
| 3,645,050 | 2/1972 | Croll et al. | 51/204 |
| 3,672,102 | 6/1972 | Johnson | 51/204 |
| 4,286,568 | 9/1981 | Komandure | 125/11 R |
| 4,300,522 | 11/1981 | Henry et al. | 125/11 R |

*Primary Examiner*—James L. Jones, Jr.

*Attorney, Agent, or Firm*—Edward J. Timmer

[57] ABSTRACT

An expandable abrasive tool is provided with an axially-extending slot receiving a single abrasive element and multiple axially aligned and axially spaced apart pockets located circumferentially from the slot with each pocket fixedly receiving an individual centering element for properly positioning and supporting the abrasive element in the hole. The axially spaced apart pockets space the centering elements apart in end-to-end relation and thereby allow torsional flexing of the tool body during hole machining without damaging the brittle centering elements. In an alternative version, multiple centering elements are received in spaced apart end-to-end relation in a single axially elongated slot instead of in individual pockets.

10 Claims, 5 Drawing Figures

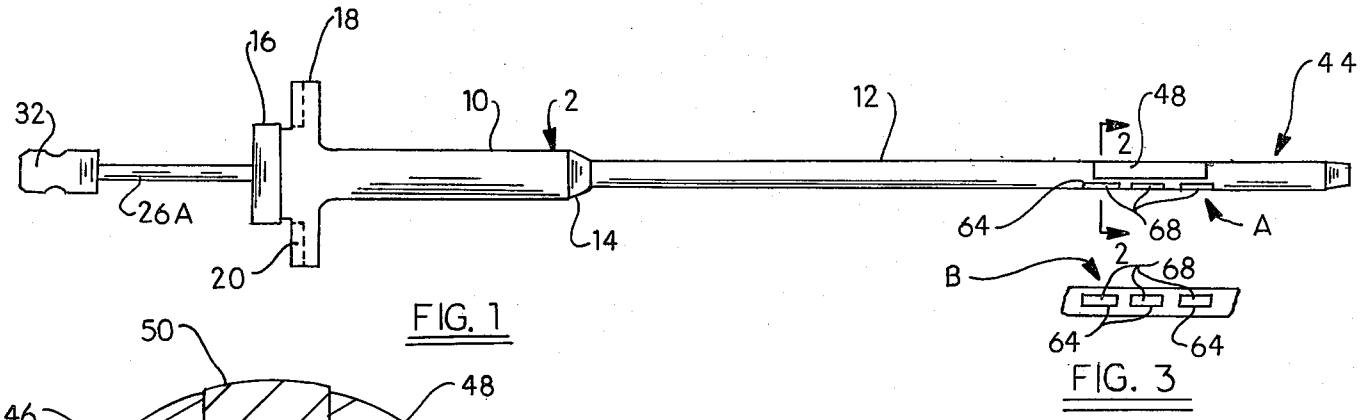
FIG. 3
FIG. 1
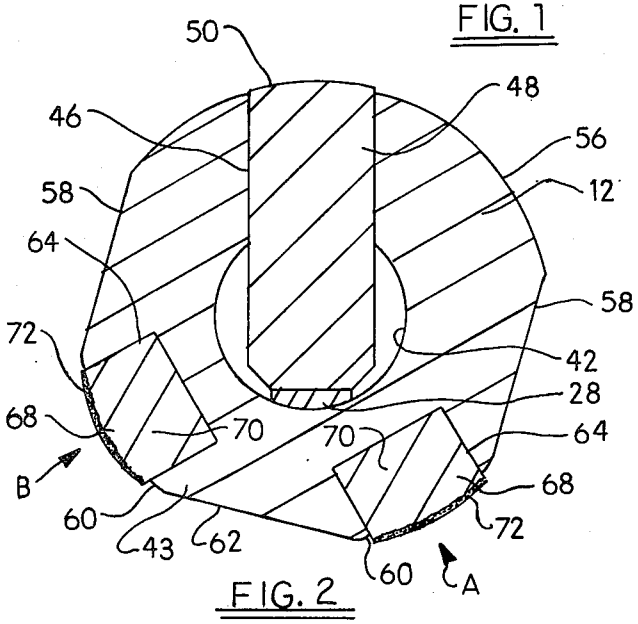
FIG. 2

ABRASIVE TOOL FOR SMALL DIAMETER HOLE MACHINING

FIELD OF THE INVENTION

The present invention relates to an expandable abrasive tool for use in sizing and finishing holes of small diameter.

BACKGROUND OF THE INVENTION

Abrasive tools expandable in size have been widely used to size and surface finish holes during a machining operation in which an abrasive insert of a tool is inserted into the hole and rotated and reciprocated therein to machine the hole.

For machining holes of relatively large diameter such as a diameter greater than one (1) inch, prior art abrasive tools have employed multiple abrasive elements spaced about the circumference of the tool, a single abrasive member with a circumferentially spaced carbide shoe, and an abrasive sleeve or helical element. Such tools are disclosed in U.S. Pat. Nos. 1,841,343; 1,874,856; 1,903,343, 1,910,658; 1,960,555; 4,173,852 and 4,199,903.

A particular expandable honing tool having an abrasive stone element and one or more bearing shoes spaced circumferentially around the tool body is illustrated in U.S. Pat. No. 2,815,615. The bearing shoes are provided to maintain constant pressure between the abrasive element and the wall of the hole being honed. The bearing shoes are made of a relatively soft metal such as a zinc alloy which wears so as not to mar the surface of the hole being honed and must be periodically replaced. The bearing shoes thus are removably attached to the tool.

For honing holes of relatively small diameter, such as diameter less than one (1) inch, the lack of space in the hole to be honed has required honing tools having simple construction and a small number of components, including a limited number of abrasive elements on the tool. For example, U.S. Pat. No. 2,787,097 illustrates a honing tool for machining relatively small diameter holes wherein the tool includes a single abrasive stone element and a pair of elongated shoes spaced 120° apart around the tool circumference to provide a three point contact with the surface of the hole being honed. The shoes are removably attached to the tool so that replacement thereof is possible to compensate for wear.

SUMMARY OF THE INVENTION

An object of the present invention is to provide an expandable abrasive tool for machining relatively small diameter workpiece holes.

Another object of the invention is to provide such an abrasive tool having a single abrasive means thereon expandable radially to vary the abrading diameter as desired and having centering means to properly position and support the abrasive means in the workpiece hole.

Still another object of the invention is to provide such an abrasive tool having means for mounting individual centering elements in spaced apart end-to-end relation along the length of the tool body so as to allow torsional flexing of the tool body during machining of the hole without damaging the centering elements.

Still another object of the invention is to provide such an abrasive tool wherein the centering elements include a wear-resistant diamond-to-diamond bonded working surface for long life.

In a typical working embodiment of the invention, the abrasive tool includes an elongate tubular body having a first axially-extending slot means adjacent the working end for receiving an abrasive element, such as a honing stone, and further includes an arbor means slidable in the body for engaging the abrasive element for abrading diameter adjustment purposes. The abrading tool also includes means, such as a plurality of axially aligned and spaced apart pockets or a second axially-extending slot, spaced circumferentially from the first slot on the tool body for fixedly mounting a plurality of centering elements in spaced apart end-to-end relation along the length of the tool body so that the tool body, which is relatively thin in cross-section compared to its length out of necessity to fit within the small hole, can undergo torsional flexing during the machining operation without damaging the brittle centering elements. This is an important feature of the invention because torsional flexing of the tool body is accentuated in machining small diameter holes as a result of the small cross-section (thinness) of the tool body relative to its length and hence lack of strength. Such torsional flexing therefore must be accommodated.

These and other object and advantages of the present invention will be explained in more detail in the following description of preferred embodiments taken with the accompanying drawings.

BRIEF DESCRIPTION OF THE DRAWINGS

FIG. 1 is an elevation of a preferred abrasive tool of the invention.

FIG. 2 is a cross-sectional view taken along lines 2—2 in FIG. 1.

FIG. 3 is a fragmentary side elevation showing the axially aligned and spaced pockets receiving centering elements.

DESCRIPTION OF PREFERRED EMBODIMENTS

Figure 4:
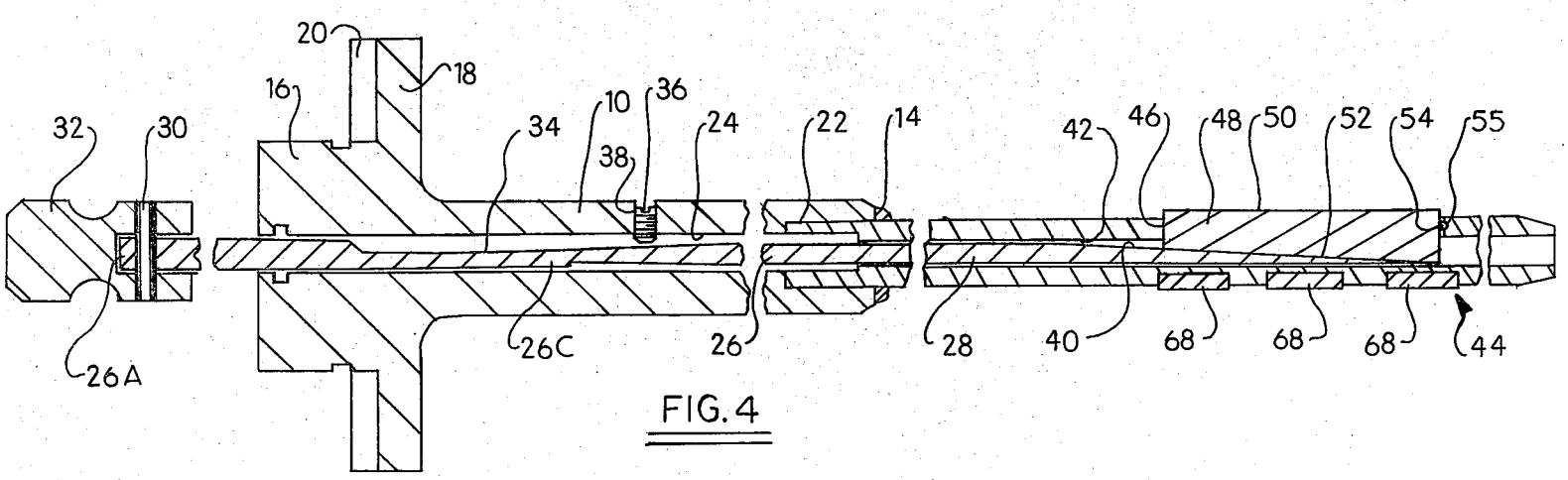
FIG. 4 is a cross-sectional view of the preferred abrasive tool of the invention.

FIGS. 1—3 illustrate an abrasive tool constructed in accordance with a preferred version of the invention. In particular, the abrasive tool includes a tool body 2 including a first tubular body 10 and second tubular body 12 silver soldered together at junction 14. The first tubular body includes a cylindrical end 16 adapted to be received in the chuck (not shown) of a conventional honing machine, for example, of the type known as Model 5H, Horizontal Stack Hones manufactured by Ex-Cell-O. A radial collar 18 is provided with alignment slots 20 for mating with ribs (not shown) on the end of the machine chuck as is well known. The first tubular body also includes a counterbore 22 at one end for receiving the end of the second tubular body 12 as shown at their junction 14. A central longitudinal bore 24 extends from the counterbore 22 through the first tubular body and slidably receives a rod portion 26 of arbor 28. The end **26*a* of the rod portion 26 extending out of the first tubular body 10 remote from the second tubular body 12 is connected by a pin 30 to a knob 32 which is adapted to be gripped by the arbor actuating mechanism in the machine chuck as is well known. An intermediate section 26*c* of the rod portion has a flat 34** ground thereon. The flat is adapted to cooperate with a transverse set screw 36 in threaded radial bore 38 to prevent the arbor 28 from rotating inside the tool body comprised of the first and second tubular bodies 10 and 12.

Extending from the intermediate section 26c of the arbor rod is a smaller diameter arbor which terminates in the second tubular body 12 in the form of an incline or wedge 40 for purposes to be explained.

It is apparent that the second tubular body 12 includes a central longitudinal bore 42 receiving the smaller diameter arbor 28. The second tubular body 12 includes a working end 44 having an axially-extending slot 46 in communication with the central bore 42. The slot receives an abrasive stone element 48 having an arcuate exterior working surface 50 and an axially inclined inner surface 52. The inclined surface 52 is complementary in shape to that of the wedge 40 and is engaged thereby when the arbor is moved axially into the tool body (to the right in FIG. 1). It is apparent that movement of the arbor 28 to the right in the FIG. 1 will cause the wedge 40 to move past the inclined inner surface 52 of the abrasive element and cause the element to move radially outwardly for abrading diameter adjustment purposes. A resilient rubber O-ring 54 is received in a chordal passage 55 drilled through the wall of the second tubular body. The passage 55 opens partially into the slot 46 so that the O-ring protrudes therein. The abrasive element 48 is held in slot 46 by the O-ring bearing against the element.

As shown best in FIG. 2, the axially-extending slot 46 and abrasive element 48 extend to the outside of the second tubular body 12 and intersect with a circular arc portion 56 of the body circumference, the abrasive element extending slightly past the arc portion 56 so as to engage the wall of the hole for abrading action such as honing. The circular arc portion 56 merges at opposite sides with a pair of flats 58 on the circumference of the tubular body 12. The flats 58 in turn merge into circular arc portions 60 with a third flat 62 between them. The flats 58 and 62 are provided along the length of the second tubular body 12 to constitute paths for lubrication and swarf clearance during the abrading operation. The flats 58 and 62 can be simply ground on a cylindrical tube from which the second tubular body 12 is formed. This arrangement of flats provides the second tubular body with the necessary lubrication and swarf clearance paths in a manner which preserves as much of the tube cross-section as possible for tube strength purposes.

Spaced around the circumference of the second tubular body 12 from the axially-extending slot 46 are two sets A, B (full set A shown in FIG. 1 and full set B in FIG. 3) of axially aligned and axially spaced apart pockets 64. It is apparent from FIG. 2 that the pockets 64 are machined into the two circular arc portions 60 on the circumference of the second tubular body and spaced apart by a web 43 of the tool body, and that the pockets do not communicate with the central bore 42. Three pockets are provided in each set and each pocket is adapted to receive a centering element 68 therein. In particular, the centering elements each comprise preferably a tungsten carbide substrate 70 and a synthesized intergrown mass or layer 72 of randomly oriented polycrystalline diamond particles bonded to the substrate. The diamond particles in the layer 72 are bonded directly together with no foreign bonding agent present. The centering elements 68 thus are highly wear resistant for long operative life and are also brittle relative to the tubular body 12. The centering elements are made from a commercially available composite material sold under the name "Compax" by General Electric Company and "Syndite" by DeBeers Company.

The centering elements are attached in pockets 64 by first nickel plating the tungsten carbide substrate and then soldering the plated substrate to the walls of the pockets 64 using low melting temperature solder such as 50/50% lead-tin melting below 500° F. The low temperature solder joining technique is preferred so that the physical properties of the heat treated 4140 carbon steel tubular body 12 are not adversely affected. The centering elements 68 for all intents and purposes are considered as permanently attached in the pockets 64 of the second tubular body 12. Of course, the centering elements 68 include a working surface comprising layer 72 which is adapted to engage the wall of the hole being machined as necessary to help center and support the tool in the hole.

The sets A, B of pockets A, B are shown spaced 90° circumferentially from one another. Set A of pockets is displaced circumferentially about 120° from the centerline of slot 46 while set B of pockets is about 150° from the slot centerline. Offsetting of the abrasive element receiving slot 46 in this manner is known to counteract certain forces exerted during honing and yields a finish machined hole with improved geometry.

Referring to FIGS. 1 and 3, an important feature of the invention is the arrangement of sets A, B of pockets 64 in axial alignment and in axial spaced apart relation to maintain the centering elements in an end-to-end relation with space between the ends to allow torsional flexing of the relatively thin cross-section second tubular body 12 during abrading of the workpiece without damaging the brittle centering elements. Without the end-to-end spacing provided by the pockets, a single elongated centering element is subject to cracking, especially of the substrates, during abrading, requiring replacement of the broken element. Torsional flexing occurs as a result of the abrasive element 48 engaging the workpiece wall during machining and is accentuated in abrading tools for small diameter holes as a result of the thin (small cross-section) of the tool body relative to its length as dictated by the dimensions of the hole. A minimum spacing of 0.062 inch between pockets 64, or centering elements 68, is sufficient to allow torsional flexing of the tool body during machining.

Figure 5:
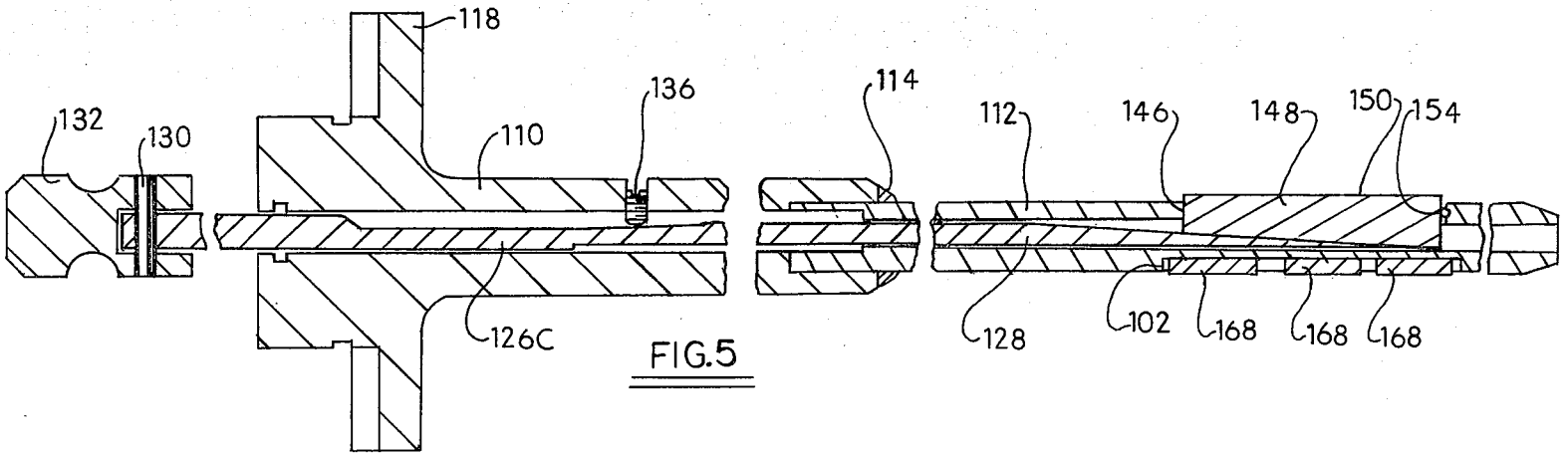
FIG. 5 is a cross-sectional view of an alternative embodiment of the invention.

An alternative embodiment of the invention is shown in FIG. 5. There a plurality of centering elements 168 are soldered as described above in a single axially-extending slot 102 in second tubular body 112, instead of in individual pockets. The centering elements, as shown, are attached in the slot in end-to-end relation with spaces between the ends to allow torsional flexing of the second tubular body during machining. Other features of the abrading tool of FIG. 5 are identical to those already described hereinabove with respect to the tool of FIGS. 1–4 and are referenced by similar numerals preceded by the numeral one.

In either the embodiment of FIGS. 1–4 or the embodiment of FIG. 5, it is important that the centering elements 68, 168 extend axially at least co-extensive with the ends of the abrasive element 48. Preferably, the first and third centering elements in FIG. 1–4 or FIG. 5 actually extend axially beyond the ends of the abrasive element as shown. This is important to insure that as the tool is entering or leaving the workpiece hole, the abrasive element will be supported and aligned properly in the hole by the centering elements. Locking of the tool in the bore and possible tool damage as a result are thereby avoided.

Those skilled in the art will appreciate that a single set or other numbers of sets of centering elements may be circumferentially disposed from the abrasive element in lieu of the two sets disclosed. Of course, the centering elements may be received in individual axially aligned and spaced pockets or in a single axially extending slot as desired and suited best for the intended machining application or the centering elements may be attached to a tool body having no slots or pockets. Further, it will be understood that various changes and modifications may be made in the embodiments described hereinabove without departing from the spirit and scope of the invention.

I claim:

1. An abrasive tool useful for machining a small diameter hole, comprising a hollow tool body having a long axis and a working end, abrasive means mounted for transverse adjustment on the working end, means in the tool body for adjusting the position of the abrasive means transverse to the tool axis, and a plurality of centering means fixedly mounted on the working end for properly positioning and supporting said tool and abrasive means in the hole, said centering means being circumferentially spaced from said abrasive means and arranged axially in end-to-end relation along the working end with sufficient space between their ends to allow torsional flexing of said tool body during machining without damaging said centering means.

2. An abrasive tool useful for machining a small diameter hole, comprising a hollow tool body having a long axis and a working end with an axially-extending first slot means and an axially-elongated second slot means disposed circumferentially from one another on the tool body, an abrasive means removably received in the first slot means, means in said hollow tool body for adjusting the position of said abrasive means radially relative to the tool body axis for abrasive diameter adjustment purposes, and a plurality of brittle centering means fixedly mounted in said second slot means for properly positioning and supporting the tool and abrasive means in the hole, said centering means being arranged axially in end-to-end relation along the working end with sufficient space between their ends to allow torsional flexing of said hollow tool body during machining without damaging said brittle centering means.

3. The tool of claim 2 wherein the second slot means comprises multiple individual pockets in said tool body axially aligned and axially spaced apart from one another in end-to-end relation with a web of the tool body spacing one pocket from the other.

4. The tool of claim 3 wherein the centering means comprises a plurality of individual centering elements with each centering element received in a respective pocket such that the pockets maintain the centering elements in spaced apart end-to-end relation.

5. The tool of claim 4 wherein the centering elements each include a diamond-to-diamond bonded working layer.

6. The tool of claim 5 wherein the layer is bonded to a carbide substrate.

7. The tool of claim 2 wherein the centering means is metallurgically attached in the second slot means.

8. The tool of claim 7 wherein the centering means comprise a plurality of centering elements each including a carbide substrate having a diamond-to-diamond bonded layer thereon, said substrate having a metallic coating on at least portions thereon to aid in metallurgical attachment of the centering elements in the second slot means.

9. The tool of claim 8 wherein the centering elements are soldered in the second slot means.

10. The tool of claim 2 wherein the tool body has a small cross-section relative to its length so that torsional flexing is accentuated during machining.

* * * * *